United States Patent [19]

Steel

[11] 3,936,986

[45] Feb. 10, 1976

[54] STRUCTURE AND METHOD FOR MOUNTING CURTAIN WALLS

[76] Inventor: John F. Steel, 1469 N. Ocean Blvd., Palm Beach, Fla. 33480

[22] Filed: Sept. 23, 1974

[21] Appl. No.: 508,643

[52] U.S. Cl. ..... 52/235; 52/378; 52/486

[51] Int. Cl.[2] ..... E04B 2/88

[58] Field of Search ..... 52/235, 478, 486, 489, 52/509, 510, 588, 593, 594, 378, 513, 434

[56] References Cited

UNITED STATES PATENTS

| | | | |
|---|---|---|---|
| 3,248,836 | 5/1966 | Monk et al. | 52/235 X |
| 3,315,426 | 4/1967 | Rolland | 52/235 |
| 3,357,145 | 12/1967 | Grossman | 52/235 |
| 3,378,969 | 4/1968 | Larger | 52/235 X |
| 3,449,879 | 6/1969 | Bloom | 52/235 X |
| 3,786,605 | 1/1974 | Winfrey | 52/235 |
| 3,822,522 | 7/1974 | Termohlen | 52/235 X |
| 3,834,099 | 9/1974 | Haeussler | 52/235 |

*Primary Examiner*—J. Karl Bell
*Attorney, Agent, or Firm*—Pennie & Edmonds

[57] ABSTRACT

A curtain wall construction and anchorage structure for cooperatively mounting the curtain wall to and between floor slabs of a building is disclosed. The curtain wall is molded as a unit to a frame carrying anchorage structure. The curtain wall facade may be in the form of a plain face, formed to provide a contour and may include doors and/or windows. Additional anchorage structure is carried by the floor slabs. These structures cooperate to provide that mounting of the curtain wall is carried out by hanging the same on the building. The edges of each curtain wall are formed to provide interlocking and sealing engagement with the adjoining edge of an adjacent curtain wall.

17 Claims, 10 Drawing Figures

40
38
43
45
31
44
52
27
46
50
48
34
63
28
47
55
58
61
42
39
36
41
35
54
11b
13
66
17
65
53
64
59
62
61
10b
72
29
75
57
52
56
74
73

FIG. 5.
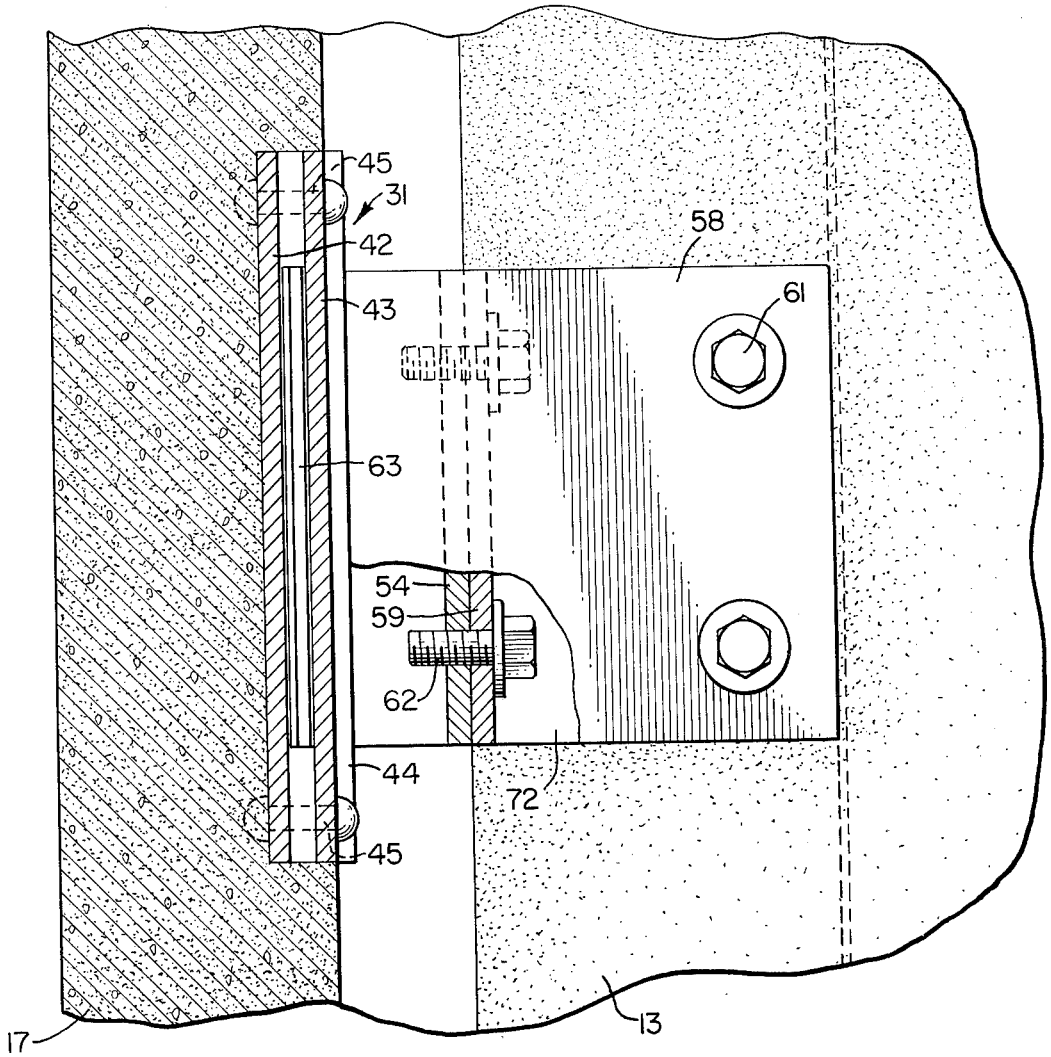
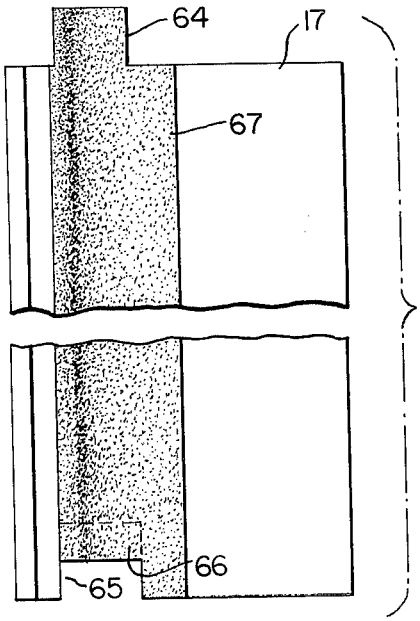
FIG. 8
FIG. 9.
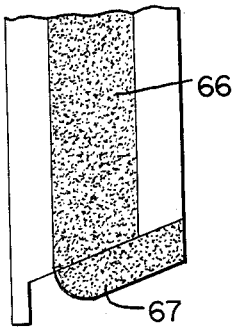

STRUCTURE AND METHOD FOR MOUNTING CURTAIN WALLS

BACKGROUND OF THE INVENTION

Present construction techniques utilize principles whereby buildings are constructed by pouring the concrete floor slab and interior dividing walls throughout one level after another until the desired number of levels have been completed. At this stage, anchor structure is mounted to the several floor slabs and the exterior shell of the building is created by placing thereabout curtain wall sections which are secured to the anchor structure.

In the known prior art techniques the curtain wall sections are bolted to the anchor structure in the securement operation. While this technique satisfies the ultimate objective of creating the shell around the building there are many disadvantages to this type of a procedure.

Firstly, the procedure is time consuming in that once the curtain wall has been moved to a desired final position a number of bolts must be tightened down on the anchor structure so that the curtain wall is secure in that position to withstand wind loading, for example.

If the curtain walls are to be bolted it is best that all structure be properly aligned for receipt of the fastening bolts. If this is not the case action must be taken to overcome the situation of non-alignment of anchoring structures. This situation may occur for many reasons including non-alignment of the flooring itself.

Additionally, the fact that the curtain wall is bolted to the anchor structure presents a rigid body which may be incapable of undergoing expansion and contraction in response to climatic conditions such that internal stresses are developed.

With costs being at least partly dependent upon man hours involved and equipment to be used at a building site it is an objective to derive the ultimate end of the completion of construction according to the building codes in the shortest possible time.

BRIEF DESCRIPTION OF THE INVENTION

The present invention seeks to derive this end, and in accordance with the teachings of the present invention, there is provided apparatus and method for hanging curtain walls between floors of a building in a simplified and rapid manner thereby to overcome the disadvantages of the prior art whereby the curtain walls are mounted by bolting the curtain walls to the floors.

In construction, the curtain wall is molded on and substantially around a supporting frame having a plurality of elements serving as anchor boxes secured thereto. The anchor boxes are disposed in an arrangement to receive cooperating anchoring structure supported by the floor slabs. Each floor slab supports anchoring structure including upper and lower hooks or finger members for receipt into the anchor boxes. The finger members are directed upwardly so that a curtain wall may be received on and lowered to a position at which the finger members cooperate with the anchor boxes and carry the load of the curtain wall.

It is contemplated that each curtain wall be supported at a plurality of upper and lower positions. To this end, the anchoring structure at each floor slab will provide a complement of upper and lower fingers equal to the number of upper and lower anchor boxes, and the curtain wall will be received over the upper fingers from anchor structure at one floor and lower fingers from anchor structure at the next higher floor to enclose the open space.

The curtain walls are formed at each edge to mate with an adjoining edge of an adjacent curtain wall to both lock the curtain walls together yet enable the curtain walls to undergo expansion and contraction. To this end, each cooperating edge of the curtain walls may be formed with tongue and groove structure, the tongue entering further into the groove during expansion of the curtain wall or retracting somewhat within the groove during contraction of the curtain wall. The joint between curtain wall sections maintains a substantially continuous facade.

A material may advantageously reside between the adjoining edges of the sections of curtain wall for sealing the interlocked edges. The curtain wall sections preferably are mounted in a sequence whereby alternate curtain walls and thereafter the intermediate curtain walls at the lowest level are hung to the anchor structure and interlocked with those curtain walls already in place, with each level following in similar manner. Thus, each curtain wall throughout the total area of the building shell is interlocked at each edge with the adjoining edge of an adjacent curtain wall.

DESCRIPTION OF THE DRAWINGS

FIG. 5 is a cross-section as seen along the line 5—5 in FIG. 4;

FIG. 8 is a fragmentary cross-section as seen along the line 8—8 in FIG. 6;

FIG. 9 is a fragmentary bottom plan view at a corner of a section of curtain wall illustrating a weatherstrip seal which extends along a vertical edge and within a horizontal channel.

DESCRIPTION OF THE PREFERRED EMBODIMENT

Figure 1:
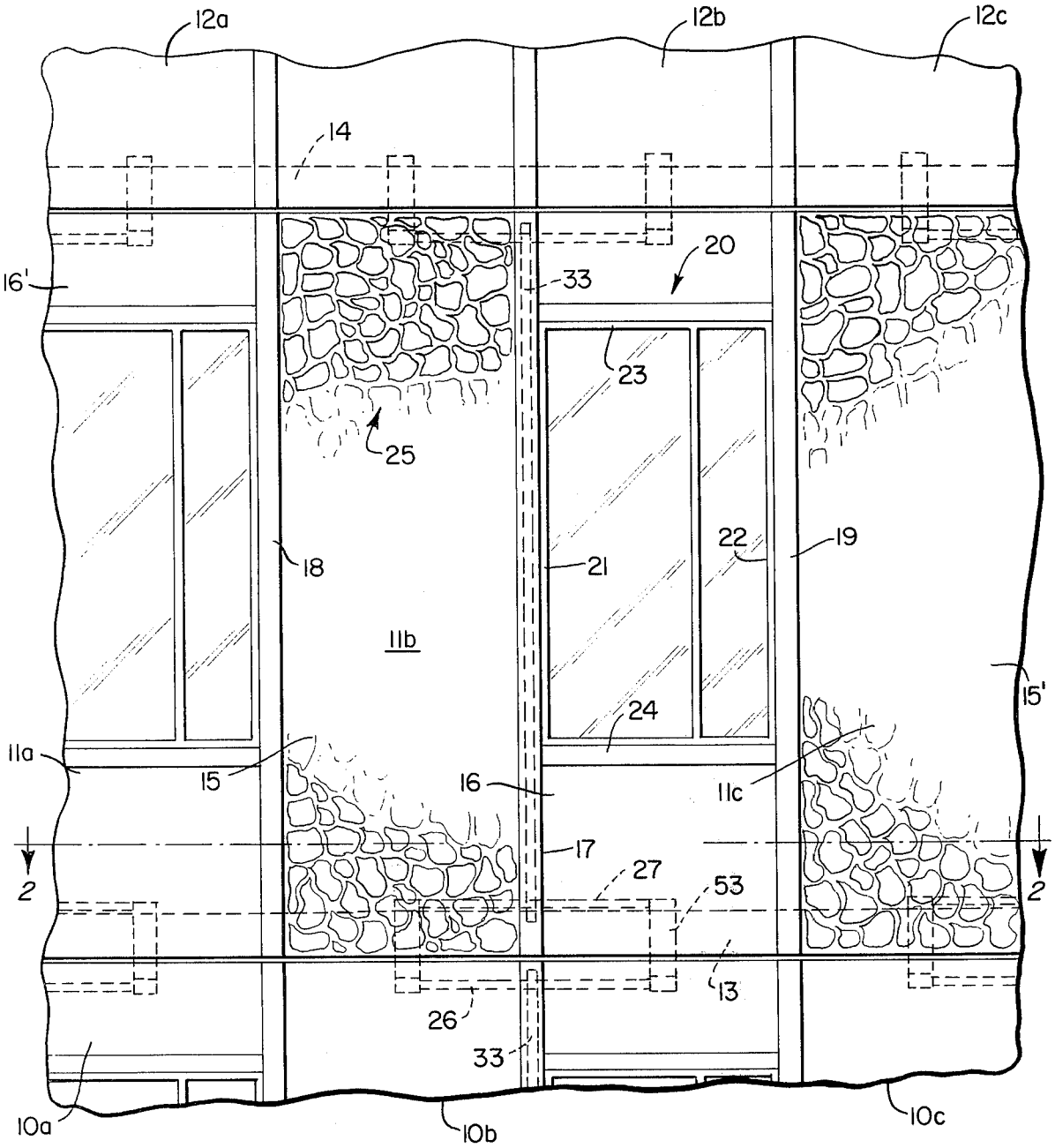
FIG. 1 is a partial view in elevation of a structure illustrating one full section of curtain wall and portions of adjacent sections on each of three adjoining floors.

A portion of the outer wall or shell of a building may be seen in FIG. 1 of the drawings. The wall includes a plurality of curtain wall sections 10*a*, *b* and *c* providing an outer wall for the floor below floor slab 13; sections 11*a*, *b* and *c* providing an outer wall for the floor between floor slabs 13 and 14; and sections 12*a*, *b* and *c* providing an outer wall for the floor above floor slab 14. Each of these individual sections of curtain wall are hung in sequence and when one floor level is completed the undertaking of commencement of the next upper floor level is begun. To be described is the manner of and the structure for hanging each section of curtain wall, which is supported partially by one floor slab and partially by an adjacent floor slab.

Figure 2:
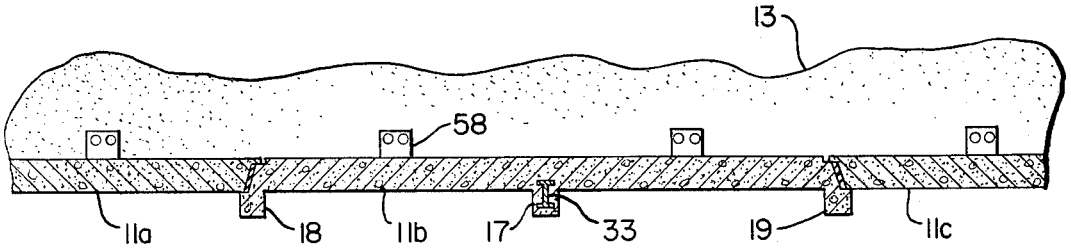
FIG. 2 is a cross-section as seen along the line 2—2 in FIG. 1.
Figure 6:
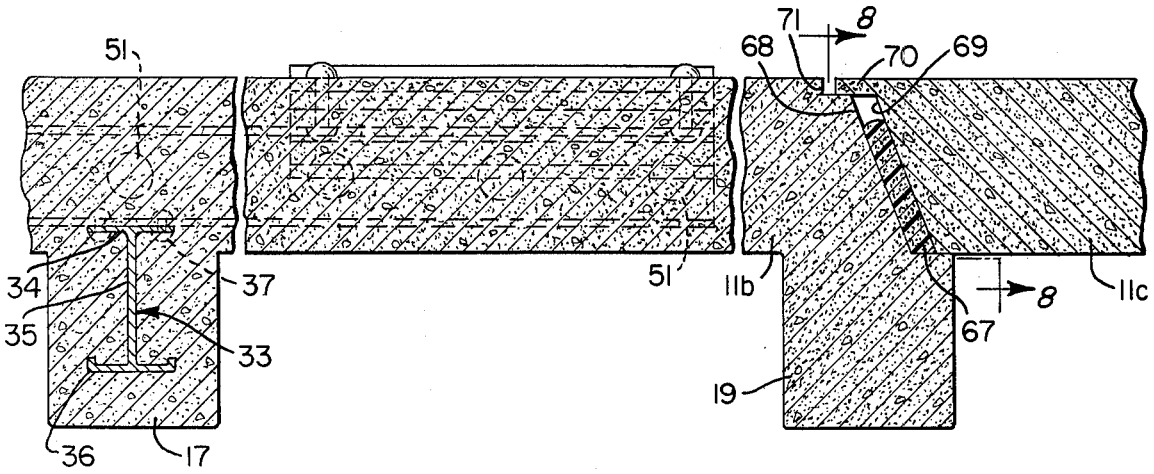
FIG. 6 is a view, somewhat similar to that of FIG. 2, although enlarged, of a portion of two adjacent sections of curtain wall illustrating a weatherstrip seal which extends vertically along abutting edges.

As may be appreciated from FIGS. 2 and 6, within each floor level alternate sections of curtain wall are hung, and then the intermediate sections of curtain wall are hung between the alternate sections then in position. Particularly, alternate sections such as sections 11*a*, 11*c* and so forth are hung and thereafter each intermediate curtain wall section such as section 11*b* is received therebetween.

Intermediate sections of curtain wall, such as section 11b, are formed to provide a pair of vertical panels 15 and 16 separated by a mullion 17. Mullions 18 and 19 are provided at the outer edge and define the width dimension of the section. All mullions 17–19 extend throughout the height of the section of curtain wall and are substantially continuous from floor to floor. The discontinuity between mullions, as may be seen in FIG. 1, is the result of the manner of mounting the sections and allows for vertical expansion in the section. In the event that the section undergos a degree of contraction, the spacing between the mullions will be slightly greater. In actual practice expansion and contraction of each section may change the overall dimension of that section by about ± ½ inches (about ± 1.27 cm).

Alternate sections of curtain wall, such as sections 11*a* and 11*c*, likewise are formed to provide a pair of vertical panels 15′ and 16′ separated by a mullion (not shown). Through the manner of mounting of the adjacent curtain wall sections 11*a*, *b* and *c* a continuity of pattern of the panels and the separating mullions will be appreciated.

The sections of curtain wall may be formed to any dimension. Generally, the size of each section is dictated by building construction carried out in accordance with local building codes. Specifications which are drawn under a typical code may dictate that the dimension between the bottom of one floor slab and the top of an adjacent floor slab be 8 feet 6 inches (about 2.6m); that the interior building walls be on centers of 25 feet 3 inches (about 7.7m); that the floor slab be 6½ inches (about 16.5cm) in thickness; and that the interior walls be 10 inches (about 25.4cm) in thickness. Therefore, the intermediate sections of curtain wall to be hung on the anchor structure supported by the floor slabs will have a width between centers of mullions 18 and 19 of 6 feet 5 inches (about 1.96m) and a height or length of 8 feet 11¾ inches (about 2.74m). The mullions themselves may be 3 inches (about 7.62 cm) in width. The alternate sections of curtain wall will be of the same height or length. Since each of the adjacent sections of curtain wall is positioned on centers of 3 feet 2½ inches (about 0.98m) the alternate sections will be of a width dimension to closely receive the intermediate sections to a planar disposition with that degree of tolerance to permit expansion of the sections without development of compressive internal stress in one section caused by stress in an adjacent section.

Several sections of curtain wall will be hung between interior building walls.

A window 20, of any type such as a casement window, is supported within panel 16 by a pair of spaced jambs 21 and 22, a header 23, and a sill 24. The panel, rather, may provide a door supported in similar well-known fashion or the panel may present a plain facade, all as desired. Similarly, panel 15 may provide a window or a door or neither a window nor a door. The disposition of doors and/or windows will be determined in part by the positioning of the particular panel relative to an interior wall and the type of structure to which the curtain walls are hung. Further aesthetic considerations may dictate such disposition. The panels may present a plain facade, a facade in the form of simulated stone as at 25 or any other aesthetically pleasing surface.

Each section of curtain wall may be molded around an internal frame. The frame serves the purpose of providing internal structural stability to each section of curtain wall and also serves to mount a plurality of anchor boxes which cooperate with anchorage structure carried by the respective floor slabs 13 and 14, for example, for purposes of hanging the curtain wall.

Figure 7:
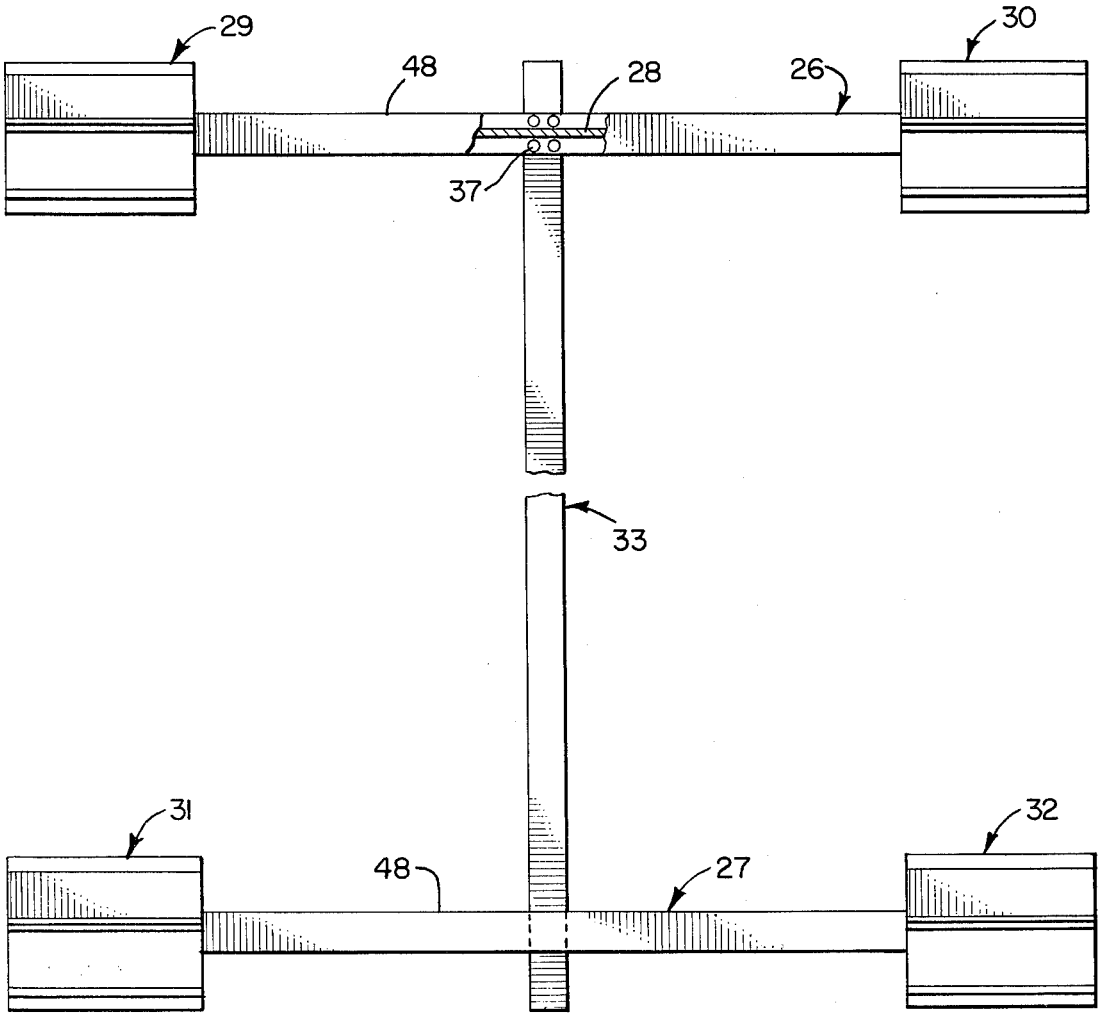
FIG. 7 is an enlarged fragmentary showing of a frame support upon which the curtain wall may be molded.

The frame may be seen to best advantage in FIG. 7. The frame includes a pair of I-beams 26 and 27 which are arranged with their webs 28 (only one shown in the Figure) perpendicular to the plane of the curtain wall to be molded thereon. Anchor boxes 29, 30, 31 and 32 (best shown in FIGS. 2 and 3), also allowing for expansion and contraction, as well as compensation for any misalignment of anchoring structure, are secured to the ends of each of the I-beams 26 and 27. Each anchor box is constructed and mounted to the respective I-beams in a similar manner. A T-beam 33 is provided for purposes of connecting and supporting I-beams 26 and 27 in spaced, parallel relation. The T-beam 33 is disposed outwardly of the plane of the panels 15 and 16 and both forms and strengthens the mullion 17. For this purpose, T-beam 33 extends both above and below the I-beams 26 and 27 to positions closer to the upper and lower edges of the sections of curtain wall.

Although not shown, it is contemplated that the frame, if additional strengthening of the curtain is desired, include structural members to define a perimeter around the components of FIG. 7. Thus, the T-beam may support a further pair of I-beams disposed both above and below the anchor boxes and extending outwardly of the anchor boxes. The ends of the I-beams may be connected by any suitable connecting structure. The connecting structure may be supported by the I-beams 26 and 27, if extended to be coextensive with the further pair of I-beams. If the modified frame is used to support a molded intermediate curtain wall a pair of side T-beams may be supported by and connected to each of the horizontally disposed I-beams. The side T-beams will form and strengthen the mullions 18 and 19.

T-beam 33 includes a foot portion 34, a web 35 and a face 36. The T-beam may be secured to the I-beams 26 and 27 in any convenient manner and by any well known means, such as rivets 37. A plurality of rivets may be employed, two on each side of web 28, as illustrated at the broken away portion in the Figure.

The frame members including T-beam 33 and the I-beams 26 and 27 may be formed of metal or of one of the plastic materials having structural integrity and being capable of formation by extrusion or otherwise to the desired cross-section. In the preferred form of the invention the frame members are aluminum. This material provides the desired structural capability, it lends itself to fabrication, and, further, the material is light so as not to substantially increase the weight of each section of curtain wall.

Figure 3:
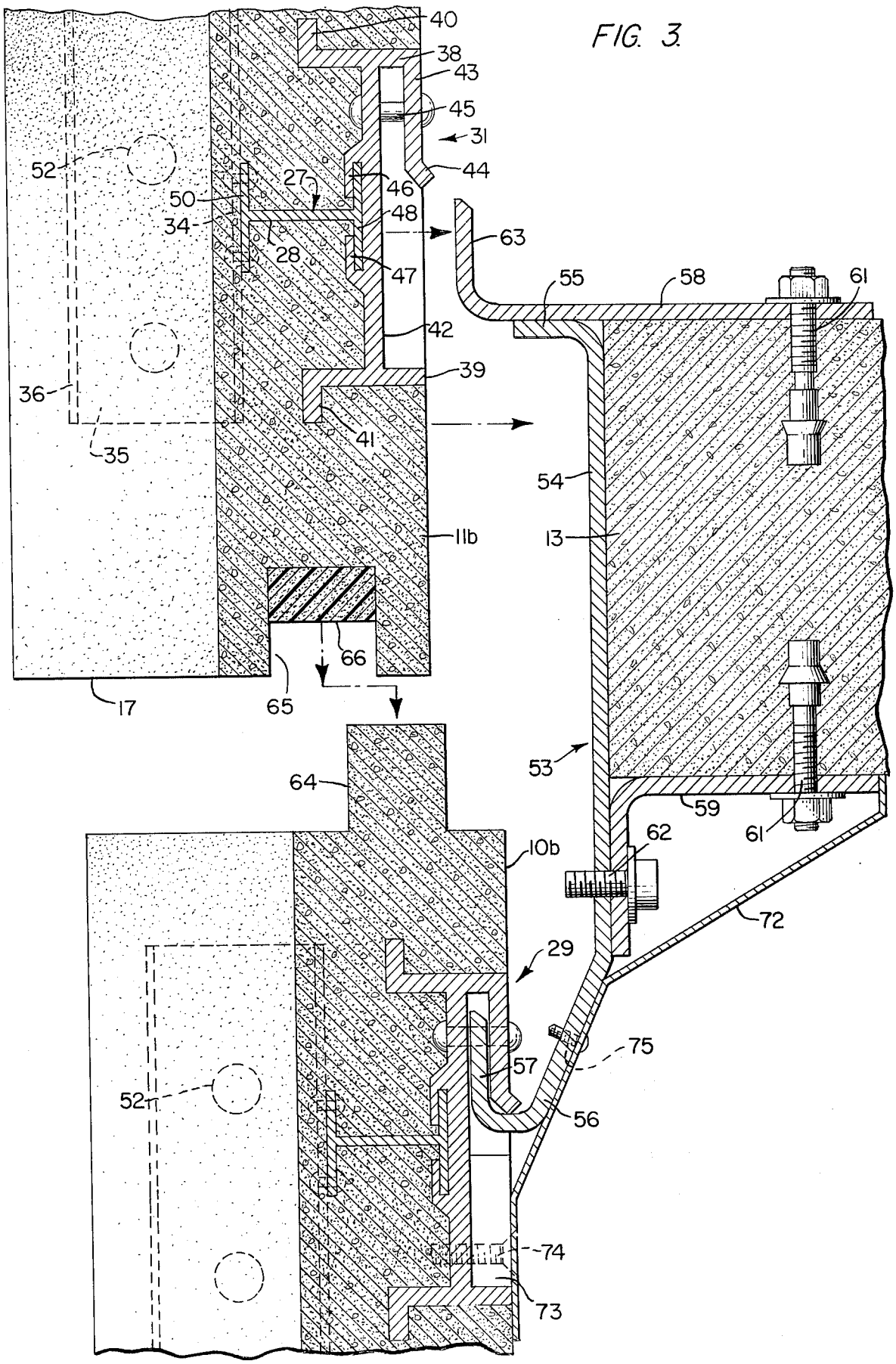
FIGS. 3 and 4 are enlarged views in cross-section of a portion of one floor slab of the structure, anchor support structure carried by the floor slab, and depicting the sequence of first hanging the sections of curtain wall to complete one floor, following thereafter by hanging sections of the curtain wall of the next upper floor.
Figure 4:
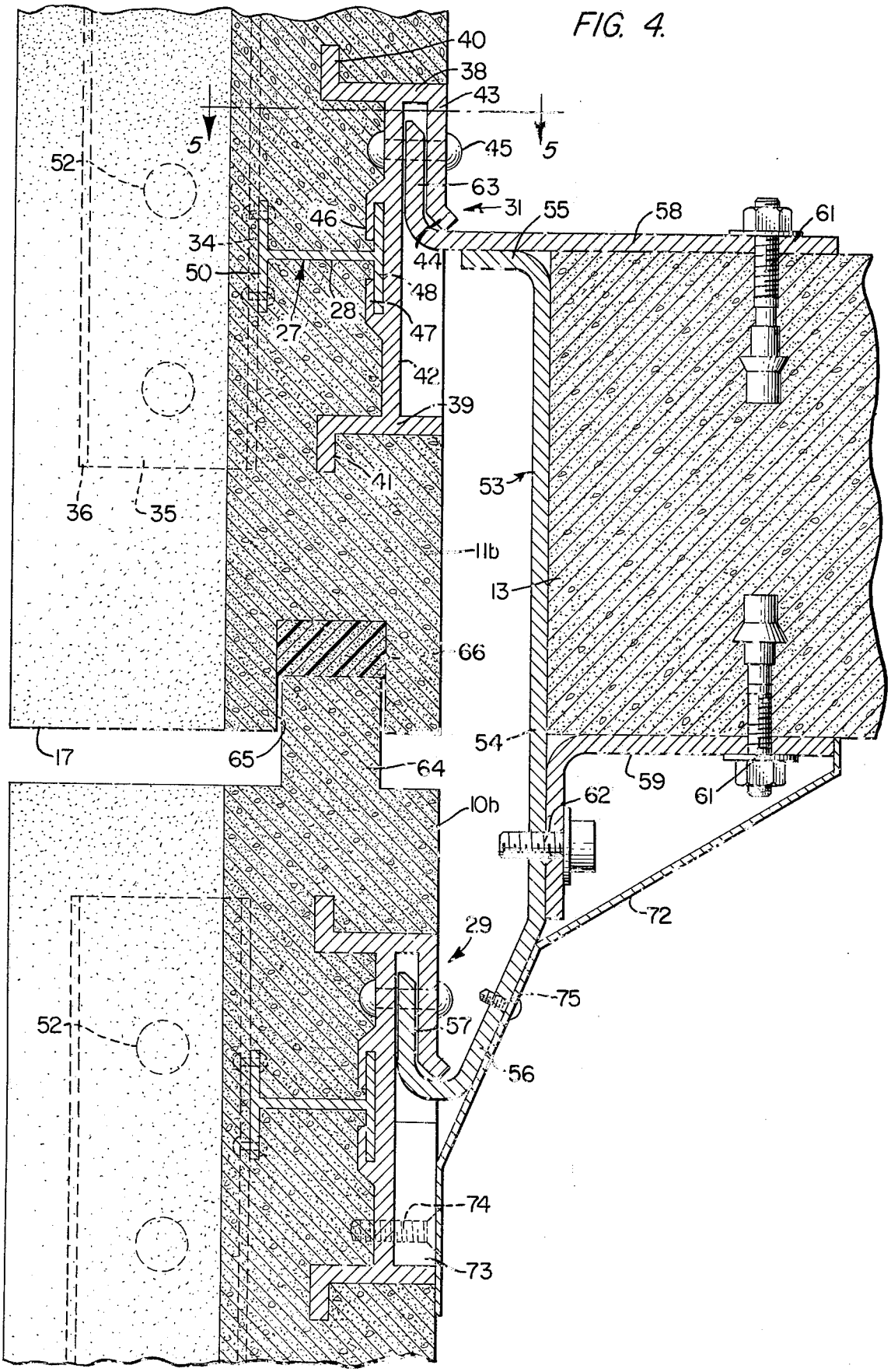

The anchor boxes, such as anchor box 29 at the upper portion of a lower section of curtain wall 10*b* and anchor box 31 at the lower portion of an upper section of curtain wall 11*b*, may be seen in FIGS. 3–5. Each of the anchor boxes are formed of metal such as steel and are identical in make-up. Therefore, a consideration directed only to anchor box 31 will suffice for all.

Anchor box 31 is positioned at the inner face of the curtain wall and includes a pair of spaced, parallel members 38 and 39 extending inwardly and perpendicular to the face. Feet 40 and 41 are located at the respective ends of the member. The feet are oppositely directed to assist in maintaining the anchor boxes in position against forces tending to pull the anchor boxes from the molded body. A wall 42 connects the members 38 and 39 between their ends. A front face 43 depends downwardly from the other end of member 38. The front face extends throughout a short distance, in an orientation parallel to the wall 42, and terminates in an outwardly directed lip 44. The spacing between the face 43 and the wall 42 provides a pocket for hanging receipt of the curtain wall on the anchorage structure, to be described, whereas the spacing between the lip 44 and the member 39 provides an entry of the anchorage structure to the pocket.

The anchor box 31 extends along the inner face over a short distance, as best seen in FIG. 5. A connector such as a rivet 45 is received through and secured to both the wall 42 and face 43 at spaced apart locations. In this manner pocket integrity is enhanced.

The wall 42 on the side opposed from the pocket is formed with a pair of fingers 46 and 47. The fingers are spaced equidistantly along their length from the wall and directed toward one another. The anchor boxes may be received over the I-beams 26 and 27 by sliding one face 48 through the pocket formed by the fingers. The web 28 extends between the fingers and joins to the other face 50. The T-beam 33 is connected to face 50 in a manner as described above, The individual anchor boxes may be secured to the I-beams in any convenient manner as by welding.

The frame is disposed in a mold frame (not shown) and supported so that the curtain wall may be molded therearound. The curtain wall may be formed of any one of plastic, metal and cementitious composition-type materials capable of undergoing molding and which display structural stability or may be made structurally stable by a frame so as to meet building requirements, including wind loading, among others. Further, the materials should both be fire and smoke resistant. A curtain wall formed of water extended polyester material has been used to advantage and is preferred.

Each of the webs 28 of the I-beams 26 and 27 as well as the web 35 of T-beam 33 are apertured such as at 51 and 52, respectively, along and at spaced locations of their lengths. Thus, increased stability is introduced to the molded curtain wall by the fact that the material is able to flow through the apertures during the molding process and to set within these apertures.

Anchorage structure for hanging the curtain walls includes an anchor plate 53 including a straight portion 54. The straight portion 54 terminates at one end in a flange 55. The other end includes an angled portion 56 and a finger 57. Both the flange and the angled portion are similarly directed toward the curtain wall and the finger is directed toward the flange. A pair of L-shaped anchor brackets 58 and 59 provide support for the anchor plate against the end of and in relation to the floor slab 13. Each anchor bracket is rigidly secured to the floor slab by a pair of anchors 61. The anchors may be a form of stud which as well known may be expanded within the opening by threading a member into the expandable housing. The anchor plate 53 is secured to the anchor brackets by any convenient means. Thus, the flange 55 may be welded to the anchor bracket 58; whereas a pair of machine screws 62 may be employed to connect the anchor bracket 59 to the straight portion 54. Anchor bracket 58 has an extended length shank so that the base portion 63 forming a finger resides in the plane of the finger 57. The finger 63, likewise, is upwardly directed.

Figure 10:
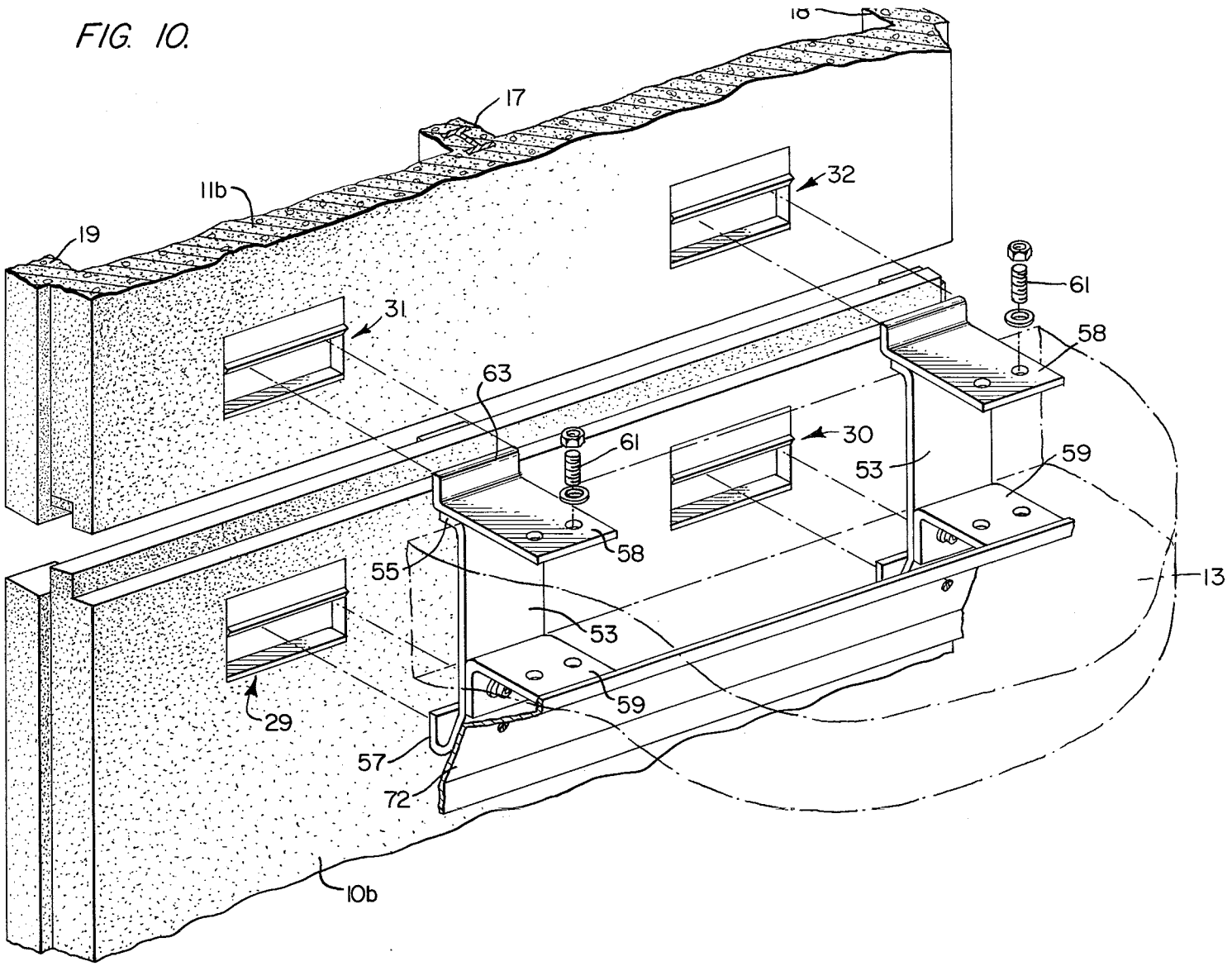
FIG. 10 is an exploded perspective of the portion of the structure as illustrated in FIGS. 3 and 4.

As is evident in FIG. 10, the anchorage structure is duplicated for disposition on floor slab 13 at spaced location. The spacing will be such that each of the pairs of fingers 63 are received in the pocket between the rivets 45. As should be apparent, the anchorage structure could be formed by individual components similarly formed.

The anchorage structure is formed of the same material as employed in the anchor boxes.

FIG. 3 illustrates the disposition of the curtain wall 10*b*, for example, which is hung by engagement of the fingers 57 in the pocket of anchor box 29. In the Figure, the curtain wall 11*b* is yet to be mounted. FIG. 4 illustrates the disposition of both curtain walls following hanging of curtain wall 11*b*. As a first step, the curtain wall 11*b* is moved into position at which its inner surface is coplanar with the inner surface of curtain wall 10*b* yet elevated above curtain wall 10*b*. In the first position the fingers 63 of anchor brackets 58 will have been received through the entry of anchor box 31 and disposed below the pocket.

Each section of curtain wall is provided with a rectangular projection 64 along and coextensive with the upper edge, and a rectangular channel 65 of complementary outline although of slightly greater depth and width along and coextensive with the lower edge. From the first position the curtain wall 10*b* may be lowered to the second position (FIG. 4) at which the projection 64 is received in channel 65 and fingers 63 are received in the pocket of anchor box 31.

While not illustrated in the Figures the upper and lower anchor boxes 29 and 31 of curtain walls 11*b* and 10*b*, respectively, similarly receive the fingers 57 of anchor plates 53 and the fingers 63 of anchor brackets 58. Thus, curtain walls 11*b*, for example, will be hung at four spaced locations to elements of the anchor structure mounted to floor slab 13 and to elements of anchor structure mounted to floor slab 14 of the next upper story.

The load of the curtain walls will be taken by the four fingers coating with the undersurface of members 38. The fingers will provide a bevelled edge to assist in passage by the lips 44. In the mounted orientation of the curtain walls a slight clearance will be maintained between the outer extension of the several lips and surfaces of anchor plates 53 and anchor brackets 58. This will enhance load distribution.

Suitably, both the upper and lower surfaces of the floor slabs may be recessed sufficiently to accommodate the anchorage structure including anchor brackets 58 and 59 and the anchor studs. Once these components of the anchorage structure are in place grouting material may be received thereover to present an overall smooth surface.

Weatherstrip material 66 is disposed within the channel 65. Like weatherstrip material 67, also, is disposed along one edge of each pair of adjoining edges of curtain wall sections 11*a* and 11*b*, for example. In short, the adjoining edges of all curtain walls are sealed.

The weatherstrip material may be any one of the commonly used caulking and sealing compounds having characteristics such as good adhesion properties and initially have a viscosity to permit ease in application along the various edges of the curtain walls. Further, the material should be applicable to the method of hanging the curtain walls whereupon a curtain wall section is moved into abutting relation with a fixed curtain section and upon setting up will retain its plastic properties of pliability over an extended time period and throughout ranges of temperatures as are likely to be experienced.

While the invention is not limited to the use of a single recited weatherstrip material which fulfills this criteria, it has been found that a weatherstrip material of asphalt impregnated polyurethane provides satisfactory results and is preferred. Though adhesion to adjoining walls at least within the area toward the ambient conditions the asphalt impregnated polyurethane weatherstrip material will aid in the prevention of temperature change within a conditioned area by substantial elimination of draft through the locations of junction and serve substantially as a barrier to migration of ambient moisture into the confines of the building.

Curtain wall sections 11*b* and 11*c* are illustrated to advantage in FIG. 6. The sections are formed in the manner such that the former section includes a plurality of mullions 17–19, whereas the latter includes a single centrally disposed mullion (not shown). Mating complementary tapered surfaces 68 and 69 define the ends of curtain walls 11*b* and 11*c*, respectively. Curtain wall 11c provides a tongue 70 and curtain wall 11*b* includes a partial groove 71. The weatherstrip material 67 initially may be disposed along either vertical surface 68 and 69 including the surface of the projection 64. Preferably, however, the weatherstrip material will be disposed as a bead along the surface 69 near the front face of curtain wall 11*c* so that when curtain wall 11*b* is received the mating surface will adhere to the weatherstrip material and move it to the disposition along the surfaces. Thus, the weatherstrip material will move toward the tongue 70, yet fill the area surrounding the bead.

As illustrated in FIG. 6, the tongue and groove along the vertical edges provide an expansion joint for horizontal expansion of each adjoining curtain wall. Similarly, the projection 64 and channel 65 acting as a tongue and groove coact to provide an expansion joint for vertical expansion of the curtain walls at this adjoining surface. The receipt of the several fingers 57 and 63 in the pockets of the anchor boxes is such to retain the hanging disposition of each curtain wall yet they coact to maintain by what may be characterized as a floating mount for the curtain walls.

Molding 72 may be employed to enclose the open space between the inside surface of curtain wall 10*b* below the anchor box 29 and the underside of floor slab 13. The molding will extend from the surface of the curtain wall and in the vicinity of that end may be attached to a block 73. Screw 74 may be used for this purpose. The block is disposed within the lower pocket of anchor box 29 (and 30) and serves the further purpose of "locking" the fingers 57 within the upper pocket region.

The other end of the molding is attached to the floor slab in any manner. If the anchor structure is exposed, the molding may be welded to the end of the anchor bracket 59. A machine screw may be used to stabilize the molding between its ends to the anchor plate 53.

Similar molding (not shown) may be employed at the upper surface of floor slab 13. This molding may have the additional function of supporting, for example, electrical conduit. The molding at both the upper and lower surfaces of the floor slab will have a lateral dimension to extend slightly beyond both anchor boxes 29 and 30.

As can be appreciated, the anchorage structure carried both by the curtain wall and a floor slab are readily cooperable so that with relative ease and in a simplified manner the curtain wall may be hung in the completion of the outer building. Each curtain wall is formed to present at its edges a surface for cooperation with a surface of an adjoining curtain wall. The cooperation is one of interlocking of adjacent curtain walls with capability that expansion in both the horizontal and vertical directions may take place without development of internal stress in any curtain wall yet with sealing maintained at each interlocking edge. The anchorage structure also provides freedom of mounting adjustment and of response to expansion and contraction by the floating-type interconnection. This is important particularly in the event of slight non-alignment of floor slabs. A locking structure may serve to prevent disassembly of the anchorage components.

Having described the invention with particular reference to the preferred form thereof, it will be obvious to those skilled in the art to which the invention pertains after understanding the invention that various changes and modifications may be made therein without departing from the spirit and scope of the invention as defined by the claims appended hereto.

What is claimed is:

1. A curtain wall for mounting between spaced floor slabs of a building each carrying upper and lower anchor elements to hangingly support said curtain wall to form a portion of the building outer shell, said curtain wall comprising:

a. a rectangular body having an inner face and an outer face spaced therefrom;

b. at least two anchor boxes each having a pocket and a wall including an entrance to said pocket; and c. frame means disposed between said faces of said body providing both structural stability to said body and a fixed mounting for said anchor boxes, at least one of said anchor boxes being disposed near the top of said body and at least one of said anchor boxes being disposed near the bottom of said body with each said anchor box disposed in cooperative relation with a respective one of said upper and one lower anchor elements on adjacent floor slabs, each said anchor box supported by said frame means with said entrance to said pocket substantially in the plane of said inner face, and each said anchor element adapted to be received through a respective one of said entrances to cooperate in said pocket for hanging mounting of said curtain wall on said anchor elements.

2. The curtain wall according to claim 1 wherein:

a. the body includes means formed along each edge for spaced interlocking cooperation with an adjoining edge of an adjacent body to permit expansion and contraction of said bodies yet maintain the shell substantially continuous.

3. The curtain wall according to claim 2 wherein:

a. the upper and lower edges of said body include one of a tongue and a groove, and b. the individual side edges of said body are tapered.

4. The curtain wall according to claim 3 including:

a. sealing means carried along at least one edge of said adjoining edges, said sealing means adhering to both edges during said expansion and contraction.

5. The curtain wall according to claim 1 wherein:

a. said outer face includes at least a pair of panels, each said panel being disposed in a direction perpendicular to the plane of said floor slabs, and b. a separator member disposed between and substantially coextensive with said panels.

6. The curtain wall according to claim 5 wherein:

a. said support means includes, 1. a pair of horizontal support members mounting an anchor box near opposed ends cooperative with similarly spaced upper and lower anchor elements, and 2. a vertical support member connecting said horizontal support members, said vertical support member extending through the plane of said outer surface, and said separator member being molded around said vertical support member.

7. The curtain wall according to claim 1 wherein:

a. each anchor box includes, 1. an upper surface extending between said inner and outer faces, and 2. an outer surface, said outer surface being coplanar with said inner face and extending by a distance to provide an entrance to a pocket below said upper surface, and b. said at least one upper and lower anchor element being received through said entrance into said pocket, said anchor elements being loaded by the weight of said body through coaction with said upper surface.

8. The curtain wall according to claim 5 wherein:

a. at least one of said panels includes framing means for supporting one of a door and a window.

9. In combination:

a. A building structure including 1. a plurality of spaced floor slabs, and 2. a plurality of upper and lower anchor elements carried at predetermined spaced locations on each floor slab; and b. a curtain wall for mounting between said spaced floor slabs to form a portion of the outer shell of said building including 1. a rectangular body having an inner face and an outer face spaced therefrom, 2. at least two anchor boxes each having a pocket and a wall including an entrance to said pocket, and 3. frame means disposed between said faces of said body providing both structural stability to said body and a fixed mounting for said anchor boxes, at least one of said anchor boxes being disposed near the top of said body and at least one of said anchor boxes being disposed near the bottom of said body with each said anchor box disposed in cooperative relation with a respective one of said upper and one lower anchor elements on adjacent floor slabs, each said anchor box supported by said frame means with said entrance to said pocket substantially in the plane of said inner face, and each said anchor element received through a respective one of said entrances to cooperate in said pocket for hanging mounting of said curtain wall on said anchor elements.

10. The combination according to claim 9 wherein:

a. the body includes means formed along each edge for spaced interlocking cooperation with an adjoining edge of an adjacent body to permit expansion and contraction of said bodies yet maintain the shell substantially continuous.

11. The combination according to claim 10 wherein:

a. the upper and lower edges of said body include one of a tongue and groove, and b. the individual side edges of said body are tapered.

12. The combination according to claim 11 including:

a. sealing means carried along at least one edge of said adjoining edges, said sealing means adhering to both edges during said expansion and contraction.

13. The combination according to claim 9 wherein:

a. said outer face includes at least a pair of panels, each said panel being disposed in a direction perpendicular to the plane of said floor slabs, and b. a separator member disposed between and substantially coextensive with said panels.

14. The combination according to claim 13 wherein:

a. said support means includes, 1. a pair of horizontal support members mounting an anchor box near opposed ends cooperative with similarly spaced upper and lower anchor elements, and 2. a vertical support member connecting said horizontal support members, said vertical support member extending through the plane of said outer surface, and said separator member being molded around said vertical support member.

15. The combination according to claim 9 wherein:

a. each anchor box includes, 1. an upper surface extending between said inner and outer faces, and 2. an outer surface, said outer surface being coplanar with said inner face and extending by a distance to provide an entrance to a pocket below said upper surface, and b. said at least one upper and lower anchor element being received through said entrance into said pocket, said anchor elements being loaded by the weight of said body through coaction with said upper surface.

16. The combination according to claim 15 including:

a. anchor support means including, 1. a plate member, 2. a pair of bracket members mounted to and extending from said floor slab, said bracket members mounting said plate member in substantially coplanar relation to said inner face, and 3. one end of bracket members and plate member comprising said upper and lower anchor elements.

17. The combination according to claim 16 wherein:

a. said anchor elements are upwardly directed fingers.

* * * * *